US007299793B1

(12) United States Patent
Tyo et al.

(10) Patent No.: US 7,299,793 B1
(45) Date of Patent: Nov. 27, 2007

(54) EGR METALLIC HIGH LOAD DIESEL OXIDATION CATALYST

(75) Inventors: Matthew A. Tyo, Glen Ellyn, IL (US); Brad J. Adelman, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/671,840

(22) Filed: Feb. 6, 2007

(51) Int. Cl.
*F02B 47/10* (2006.01)
*F02B 47/08* (2006.01)

(52) U.S. Cl. ..... 123/568.12; 123/568.11

(58) Field of Classification Search ..... 123/568.11, 123/568.12; 60/605.2, 612, 599
See application file for complete search history.

(56) References Cited

U.S. PATENT DOCUMENTS 6,516,787 B1 * 2/2003 Dutart et al. ..... 123/539
6,851,414 B2 * 2/2005 Gao et al. ..... 123/568.12
7,165,540 B2 * 1/2007 Brookshire et al. .... 123/568.12
2004/0050373 A1 * 3/2004 Gao et al. ..... 123/568.12
2005/0103013 A1 * 5/2005 Brookshire et al. ..... 60/605.2
2006/0124115 A1 * 6/2006 Brookshire et al. .... 123/568.12
2007/0137627 A1 * 6/2007 Durand et al. ..... 123/568.12

* cited by examiner

*Primary Examiner*—Mahmoud Gimie
(74) *Attorney, Agent, or Firm*—Jeffrey P. Calfa; Gerald W. Askew

(57) ABSTRACT

A compression ignition engine (10) has an EGR loop (22) that contains a metallic DOC (30) for treating recirculated exhaust gas obtained directly from cylinder exhaust through an exhaust manifold (16) before the exhaust gas passes through a cooler (26, 28) and an EGR valve (24) to an intake system (18).

14 Claims, 1 Drawing Sheet

EGR METALLIC HIGH LOAD DIESEL OXIDATION CATALYST

FIELD OF THE INVENTION

This invention relates to internal combustion engines, including particularly, compression ignition (i.e. diesel) engines. More specifically, the invention relates to improvements in EGR (exhaust gas recirculation) loops for maintaining effectiveness of EGR coolers in the loops.

BACKGROUND OF THE INVENTION

The use of EGR as an addition to charge air introduced into cylinders of an engine aids in controlling tailpipe emissions, especially NOx and particulates. A typical EGR loop has an inlet that is in communication with the engine exhaust system and an outlet that is in communication with the engine intake system. An EGR valve controls flow of exhaust gas through the loop from the exhaust system to the intake system.

Depending on the pierce point of the EGR loop to the exhaust system, an EGR cooler may be included in the loop to cool the exhaust before it reaches the EGR valve. The EGR cooler size is a function of the maximum temperature drop that is needed. The larger the maximum temperature drop, the larger the cooler size.

Constraints on available space may also affect the geometry of an EGR cooler and the number of coolers that are needed in a loop to provide the maximum temperature drop.

Because the maximum temperature drop that an EGR cooler is designed to provide is needed typically during only some of part of the total engine running time, other parts of the running time don't require the same EGR cooling capacity. However, because EGR cooler geometry doesn't change as engine operating conditions change, exhaust may at times be cooled to lower temperatures than it otherwise would if the EGR cooler were smaller.

It has been observed from actual engine testing that an EGR cooler sized to provide a certain outlet temperature at maximum heat rejection may lose cooling efficiency as accumulated engine running time increases. Loss of needed cooling efficiency can have potentially unfavorable implications for an emission control strategy. Furthermore, different engine operating conditions create varying degrees of unburned hydrocarbons and soot in engine exhaust.

In order to provide the cooling capacity within available space for handling occasional maximum cooling needs, the cooler in the EGR loop of the tested engine was actually two EGR coolers connected in series. Over time however, the running of the engine was found to cause sticky, soot-like material to be deposited on cooler surfaces. For example, the cooler outlet became noticeably caked with such deposits. The deposits can also occur on the EGR valve, potentially impairing its operation.

The accumulation of the deposits was believed due to a combination of factors including varying degrees of unburned hydrocarbons and soot in engine exhaust and the reduced temperature of EGR leaving the cooler that occurred when the engine was operating in ways that needed less than the cooling capacity that the two EGRs provided.

One way of avoiding such reduced temperatures, and hence discouraging the accumulation of undesirable deposits, would be to add a by-pass around one or both coolers for some lower exhaust temperature situations. Such a modification requires additional hardware and controls, including conduits, fitting, and one or more by-pass control valves.

SUMMARY OF THE INVENTION

Briefly, the present invention provides a solution that doesn't require such extensive modification to the EGR loop. Instead, a preferred embodiment utilizes a metallic high load diesel oxidation catalyst (DOC) in the EGR loop upstream of the cooler. "High load" refers to a high loading of platinum group metals (PGM), specifically platinum and palladium, a loading that is significantly higher than that in standard underfloor catalysts. The metallic high load DOC is a passive device in the sense that it has no moving parts and requires no external controls to operate it. It is simply connected into the EGR loop.

Actual use of a metallic high load DOC was found to significantly reduce the accumulation of deposits on EGR cooler surfaces, enabling cooler efficiency to be maintained and emission control strategy to be unimpaired by loss of cooler efficiency.

In the preferred installation, the metallic high load DOC was placed between an engine exhaust manifold and the EGR cooler.

The metallic high load DOC comprises a low restriction metallic substrate, a metal foil for example, that allows desired maximum EGR rates to continue to be achieved. A preferred metallic high load DOC comprises a high platinum group metals (PGM) loading located before the EGR cooler. An advantage of the use of Platinum and Palladium is the ability of the DOC to maintain efficiency upon a return to lower temperature EGR flow after a period of high temperature EGR flow. High temperature EGR flow typically occurs when the engine runs at high engine load.

By placement of the metallic high load DOC in close physical proximity to an exhaust manifold, it is believed that the DOC can exhibit improved operational effectiveness in comparison to placement at other locations because of its exposure to manifold and engine heat. The inclusion of this DOC in the EGR loop, even when placed in close proximity to an exhaust manifold, should also have no significant impact on hydrocarbons (HC) that are intentionally created at certain times in engine exhaust for conveyance through a turbocharger to an underfloor DOC in a motor vehicle where they are burned to raise exhaust temperature to levels suitable for regenerating a diesel particulate filter (DPF) or catalyzed DPF further downstream in the exhaust system. The burning of increased amounts of HC in exhaust flow through the metallic high load DOC create a rise in EGR gas temperature. This higher temperature could aid in burning off deposits in the cooler due to the engine having been operating at lower loads characterized by lower exhaust gas temperature.

One generic aspect of the present invention relates to an internal combustion engine comprising engine cylinders within which combustion occurs to run the engine, an intake system for delivering air to the cylinders, a fueling system for delivering fuel to the cylinders, an exhaust system through which exhaust gas resulting from combustion within the cylinders is exhausted, and an EGR loop for conveying exhaust gas from the exhaust system to the intake system to entrain some of the exhaust gas from the exhaust system with air being delivered through the intake system to the cylinders.

The EGR loop comprises a metallic diesel oxidation catalyst (DOC) for treating untreated cylinder exhaust gas conveyed through the EGR loop.

Another generic aspect of the invention relates to a method of exhaust gas recirculation in an internal combustion engine having engine cylinders within which combustion occurs to run the engine, an intake system for delivering air to the cylinders, a fueling system for delivering fuel to the cylinders, an exhaust system through which exhaust gas resulting from combustion within the cylinders is exhausted, and an EGR loop for conveying exhaust gas from the exhaust system to the intake system to entrain some of the exhaust gas with air being delivered to the cylinders.

The method comprises treating recirculated exhaust gas conveyed through the EGR loop by causing untreated cylinder exhaust gas to be conveyed through a metallic diesel oxidation catalyst (DOC) in the loop The foregoing, along with further features and advantages of the invention, will be seen in the following disclosure of a presently preferred embodiment of the invention depicting the best mode contemplated at this time for carrying out the invention. This specification includes a drawing, now briefly described as follows.

DESCRIPTION OF THE PREFERRED EMBODIMENT

Figure 1:
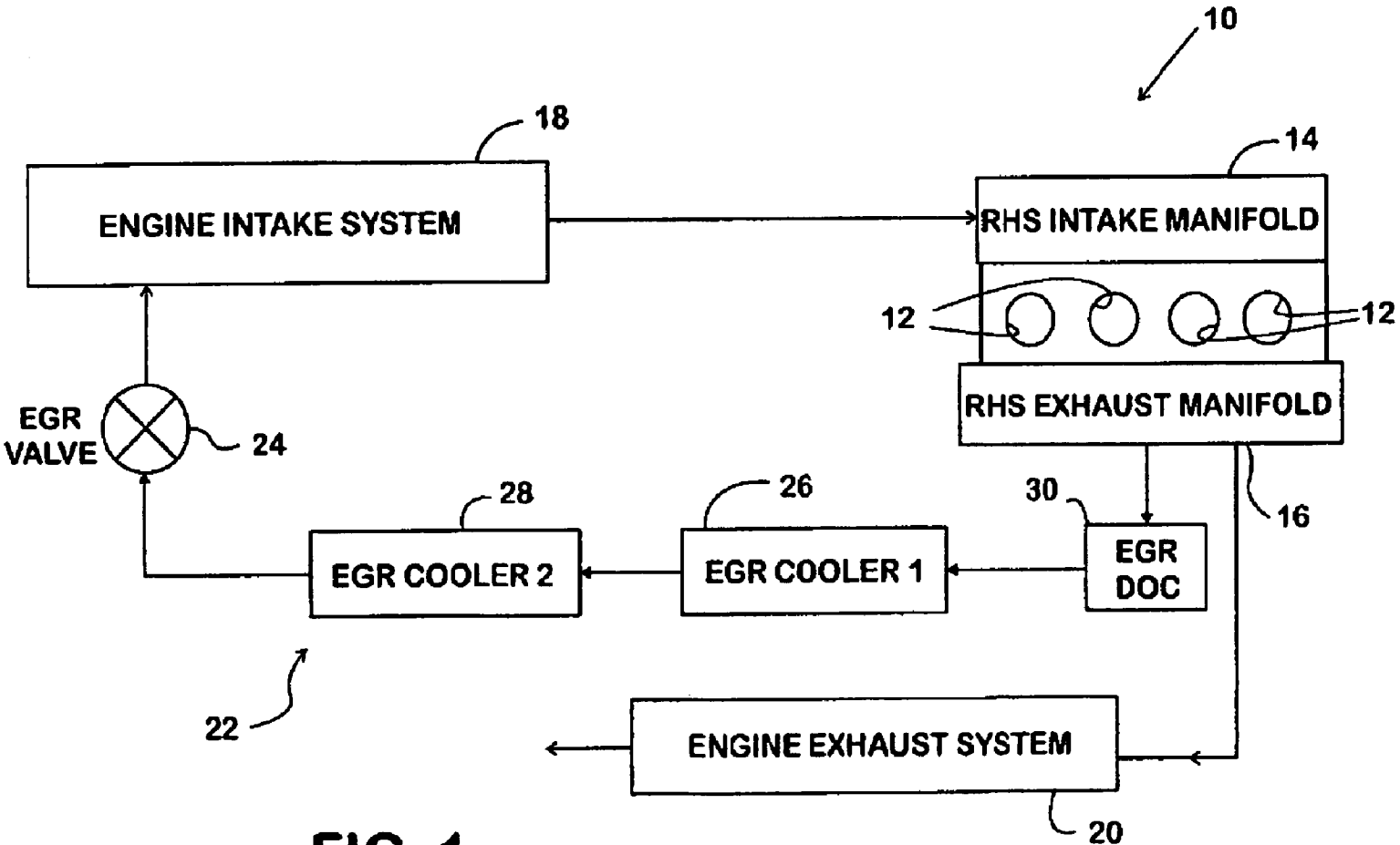
FIG. 1 is a general schematic diagram of those portions of an exemplary diesel engine relevant to principles of the present invention.

FIG. 1 shows schematically a portion of an exemplary turbocharged diesel engine 10 for powering a motor vehicle. Engine 10 comprises cylinders 12 within which pistons (not shown) reciprocate. Each piston is coupled to a respective throw of a crankshaft by a corresponding connecting rod (also not shown). A V-shape engine has two banks of cylinders, but only the right hand side bank is shown in the drawing. Associated with the bank is an intake manifold 14 and an exhaust manifold 16.

Engine 10 comprises an intake system 18 and an exhaust system 20. Turbocharging is provided by a turbocharger (not shown) having one or more turbines in exhaust system 20 that operate one or more compressors in intake system 18.

Engine 10 further comprises an exhaust gas recirculation (EGR) loop 22 between exhaust system 20 and intake system 18. EGR loop 22 provides high-pressure EGR by having an inlet communicated directly to cylinder exhaust through exhaust manifold 16 and an outlet that is communicated to intake system 18 between the compressor stage(s) and intake manifold 14. EGR loop comprises an EGR valve 24 for controlling flow through the loop and two EGR coolers 26, 28 for cooling the flow.

In accordance with principles of the invention, loop 22 comprises a metallic diesel oxidation catalyst (DOC) 30 for treating exhaust gas recirculated through the loop. Preferably metallic DOC 30 is disposed to treat untreated exhaust gas entering loop 30 so that only treated exhaust gas passes through coolers 26, 28, and valve 30 in that order.

Metallic DOC 30 comprises a housing internally of which is disposed a substrate having surfaces containing high platinum group metals (PGM). It is those materials that treat the entering exhaust. Metallic DOC 30 is a passive device that provides a low restriction to flow allowing desired maximum EGR rates to continue to be achieved for proper EGR control. The use of Platinum and Palladium as the catalytic materials enables catalytic efficiency to be maintained over a range of EGR temperatures, and especially when lower temperature EGR flow returns after a period of high temperature flow.

Metallic DOC 30 is preferably disposed in proximity to exhaust manifold 16, and loop 22 preferably has a pierce point to the exhaust system at the exhaust manifold. This provides highest temperature exhaust gas for recirculation before any heat is extracted by the turbocharger turbine(s).

While a presently preferred embodiment of the invention has been illustrated and described, it should be appreciated that principles of the invention apply to all embodiments falling within the scope of the following claims.

What is claimed is:

1. An internal combustion engine comprising:

engine cylinders within which combustion occurs to run the engine;

an intake system for delivering air to the cylinders;

a fueling system for delivering fuel to the cylinders;

an exhaust system through which exhaust gas resulting from combustion within the cylinders is exhausted; and an EGR loop for conveying exhaust gas from the exhaust system to the intake system to entrain some of the exhaust gas from the exhaust system with air being delivered through the intake system to the cylinders;

wherein the EGR loop comprises a metallic diesel oxidation catalyst (DOC) for treating untreated cylinder exhaust gas conveyed through the EGR loop, and the entire flow of exhaust gas through the metallic DOC is conveyed to the intake system.

2. An engine as set forth in claim 1 wherein the EGR loop further comprises an EGR valve disposed downstream of the metallic DOC for controlling flow of exhaust gas conveyed through the EGR loop.

3. An engine as set forth in claim 1 wherein the EGR loop further comprises an EGR cooler disposed downstream of the metallic DOC for cooling exhaust gas conveyed through the EGR loop.

4. An engine as set forth in claim 3 wherein the EGR cooler comprises two individual coolers in succession in the EGR loop, and the EGR loop further comprises an EGR valve downstream of the two individual coolers for controlling flow of exhaust gas through the EGR loop.

5. An engine as set forth in claim 1 wherein the metallic DOC comprises a substrate having surfaces containing high platinum group metals (PGM).

6. An engine as set forth in claim 1 wherein the metallic DOC is disposed in proximity to an exhaust manifold on the engine and the EGR loop has a pierce point to the exhaust system at the exhaust manifold.

7. An engine as set forth in claim 1 wherein the engine operates by compression ignition of fuel injected into the cylinders.

8. A method of exhaust gas recirculation in an internal combustion engine having engine cylinders within which combustion occurs to run the engine, an intake system for delivering air to the cylinders, a fueling system for delivering fuel to the cylinders, an exhaust system through which exhaust gas resulting from combustion within the cylinders is exhausted, and an EGR loop for conveying exhaust gas from the exhaust system to the intake system to entrain some of the exhaust gas with air being delivered to the cylinders, the method comprising:

treating exhaust gas conveyed through the EGR loop by causing untreated cylinder exhaust gas to be conveyed through a metallic diesel oxidation catalyst (DOC) that exclusively treats exhaust gas being conveyed through the loop.

9. A method as set forth in claim 8 wherein the step of causing untreated cylinder exhaust gas to be conveyed through a metallic diesel oxidation catalyst (DOC) comprises causing the untreated cylinder exhaust gas to be conveyed through the metallic DOC before being conveyed through an EGR valve that is disposed in the loop downstream of the metallic DOC and that controls flow through the loop.

10. A method as set forth in claim 8 wherein the step of causing untreated cylinder exhaust gas to be conveyed through a metallic diesel oxidation catalyst (DOC) comprises causing the untreated cylinder exhaust gas to be conveyed through the metallic DOC before being conveyed through an EGR cooler that is disposed in the loop downstream of the metallic DOC and that cools flow through the loop.

11. A method as set forth in claim 8 wherein the step of causing untreated cylinder exhaust gas to be conveyed through a metallic diesel oxidation catalyst (DOC) comprises causing the untreated cylinder exhaust gas to be conveyed through the metallic DOC before being conveyed through individual EGR coolers that are disposed in succession in the loop downstream of the metallic DOC for cooling flow through the loop.

12. A method as set forth in claim 8 wherein the step of causing untreated cylinder exhaust gas to be conveyed through a metallic diesel oxidation catalyst (DOC) comprises passing the exhaust gas across a substrate that is disposed within a housing of the metallic DOC and that has surfaces containing high platinum group metals (PGM).

13. A method as set forth in claim 8 including exposing the metallic DOC to heat from an exhaust manifold of the engine and communicating the metallic DOC via the exhaust manifold directly to cylinder exhaust gas.

14. A method as set forth in claim 8 comprising operating the engine by compression ignition of fuel injected into the cylinders.

* * * * *